US007956268B1

(12) United States Patent
Liao

(10) Patent No.: US 7,956,268 B1
(45) Date of Patent: Jun. 7, 2011

(54) FOOT PEDAL STRIKING ADJUSTMENT APPARATUS

(76) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 12/695,172

(22) Filed: Jan. 28, 2010

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS 5,343,792 A * 9/1994 Liao ..... 84/422.1
5,398,584 A * 3/1995 Liao ..... 84/422.1
6,222,108 B1 * 4/2001 Liao ..... 84/422.1
6,872,023 B2 * 3/2005 Liao ..... 403/84
6,903,257 B2 * 6/2005 Yun ..... 84/422.1
7,579,539 B2 * 8/2009 Chen ..... 84/422.1
7,579,540 B2 * 8/2009 Takegawa ..... 84/422.1
7,663,041 B1 * 2/2010 Lin ..... 84/422.1
7,812,237 B1 * 10/2010 Dunnett ..... 84/422.1

* cited by examiner

*Primary Examiner* — Jeffrey Donels
*Assistant Examiner* — Robert W Horn
(74) *Attorney, Agent, or Firm* — Muncy, Geissler, Olds & Lowe, PLLC

(57) ABSTRACT

A foot pedal striking adjustment apparatus is installed on an axle of a foot pedal percussion instrument. The axle is hinged on an upper side of a pair of bracing posts. The bracing posts have a lower side fastened to a foot pedal holder. The foot pedal holder has a rear side hinged on a pedal. The foot pedal striking adjustment apparatus comprises a flywheel holder run through by the axle to turn synchronously, a flywheel having a lower side hinged on a clamping element to form a clamping space to clamp the flywheel holder. The flywheel and clamping element are movable forwards and rearwards to change pendent range of a drawing element suspended from the flywheel. Thereby the gradient of the pedal can be adjusted to alter the striking force on a drum.

9 Claims, 5 Drawing Sheets

FOOT PEDAL STRIKING ADJUSTMENT APPARATUS

FIELD OF THE INVENTION

The present invention relates to a pedal gradient adjustment apparatus for percussion instruments with a foot pedal.

BACKGROUND OF THE INVENTION

A conventional percussion instrument with a foot pedal, referring to FIG. 1, mainly comprises a foot pedal 1 which is mounted a pair of upright bracing posts 2 at the front side, a hexagonal axle 3 is hinged transversely on an upper side of the bracing posts 2, a chain wheel 4 is run through by the axle 3, a drumstick holder 5 is located at one side of the chain wheel 4 and a drumstick 6 is fastened to the drumstick holder 5. The foot pedal 1 has a rear side hinged on a rear end of a pedal 7. The pedal 7 has a front end connected to a lower end of a chain 8. The chain 8 has an upper end containing a plurality of chain links engaged with chain teeth formed on the circumference of the chain wheel 4. The last chain link at the upper end of the chain 8 is run through by a pin 9 to engage with the chain wheel 4. The pedal 7 is positioned in an inclined manner with the front end at a higher elevation.

When in use, a performer steps the pedal 7 with a foot to draw the chain 8 downwards and drive the chain wheel 4 to turn, the drumstick holder 5 is turned at the same time to drive the drumstick 6 to strike the head of a drum (not shown in the drawing).

The greater the gradient of the pedal 7, the stronger the force the drumstick 6 striking the head of the drum, and louder and clearer sound of the drum is generated. On the other hand, the smaller gradient of the pedal 7 generates a smaller sound of the drum. Hence by adjusting the gradient of the pedal 7, the striking force of the drum can be changed according to different musical composition. Adjustment is generally accomplished by altering the pendent range of the chain 8 so that the gradient of the pedal 7 can be changed. However, due to the last chain link at the upper end of the chain 8 is fastened to the chain wheel 4 through the pin 9, adjusting the gradient of the pedal 7 has to disassemble the pin 9 and to change the pin hole at a different location where the pin 9 runs through the chain wheel 4 so that the force of striking the drum can be changed. Such a process is awkward and troublesome.

SUMMARY OF THE INVENTION

The primary object of the present invention is to make change of striking force on a drum faster and easier.

To achieve the foregoing object, the present invention provides a foot pedal striking adjustment apparatus to be installed on an axle of a foot pedal percussion instrument. The axle is hinged on an upper side of a pair of bracing posts. The bracing posts have a lower side fastened to a foot pedal holder. The foot pedal holder has a rear side hinged on a pedal. The foot pedal striking adjustment apparatus of the present invention comprises a flywheel holder, a flywheel and a drawing element. The flywheel holder is run through transversely by the axle and turns synchronously with the axle. The flywheel has a lower front side hinged on a clamping element. The clamping element and the flywheel form a clamping space between them. The flywheel holder is held in the clamping space. The flywheel and the clamping element can be moved forwards and rearwards to clamp the flywheel holder. The clamping element has a rear side opened and coupled with the flywheel through a fastening element to clamp the flywheel holder. The drawing element has an upper end connected to the circumference of the flywheel and a lower end connected to a front end of the pedal such that the pedal is formed in an inclined manner with the front end at a higher elevation.

By means of the construction set forth above, the positions of the flywheel and clamping element clamping the flywheel holder forwards and rearwards can be adjusted to change the pendent range of the drawing element, and the gradient of the pedal can be altered accordingly. Therefore, the striking force on the drum can be adjusted according to different musical composition. Operation is easier and faster.

The foregoing, as well as additional objects, features and advantages of the invention will be more readily apparent from the following detailed description, which proceeds with reference to an embodiment and accompanying drawings. The embodiment serves merely for illustrative purpose and is not the limitation of the invention.

DETAILED DESCRIPTION OF THE PREFERRED EMBODIMENT

Figure 1:
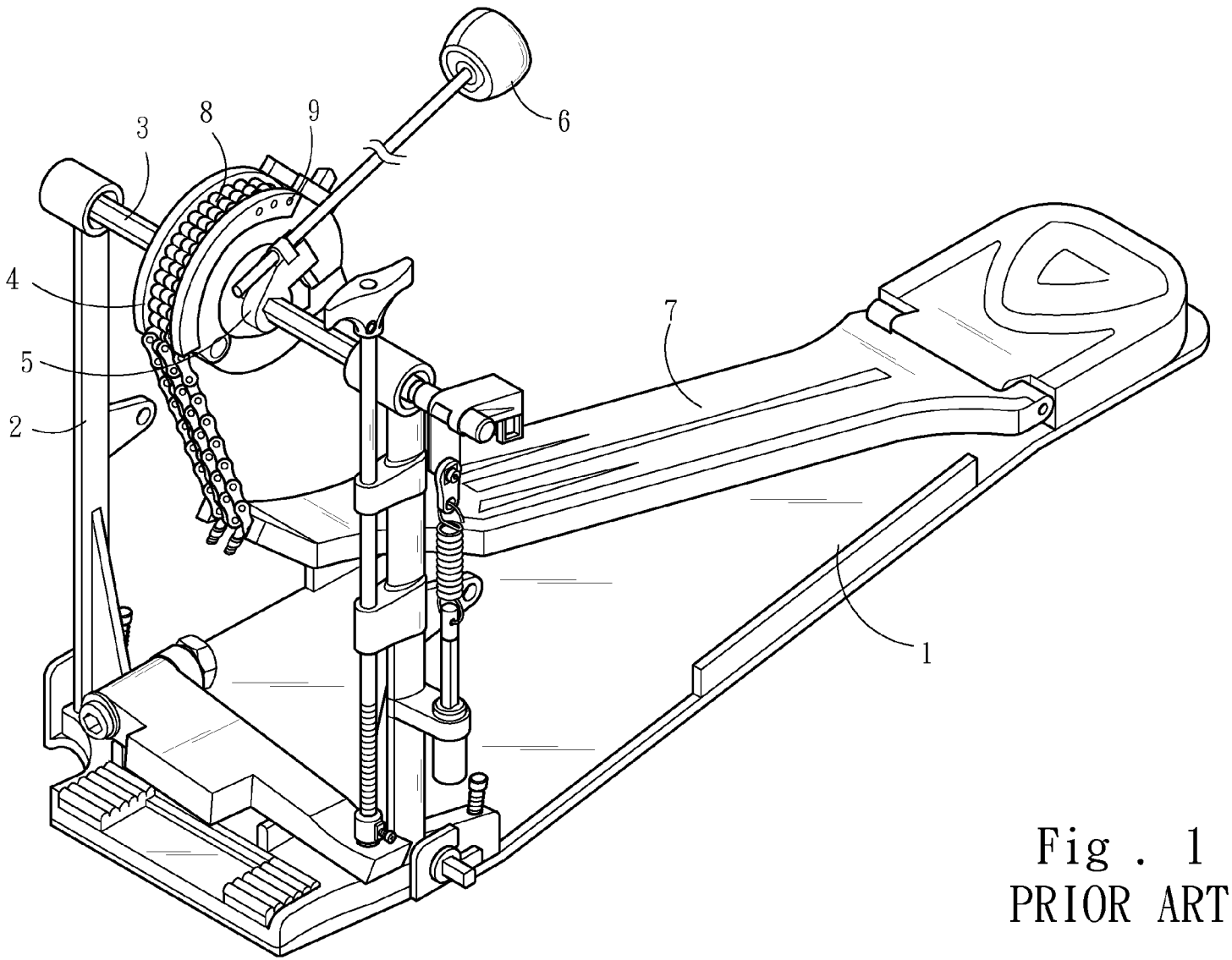
Fig. 1 PRIOR ART
FIG. 1 is a perspective view of a conventional foot pedal percussion instrument.
Figure 2:
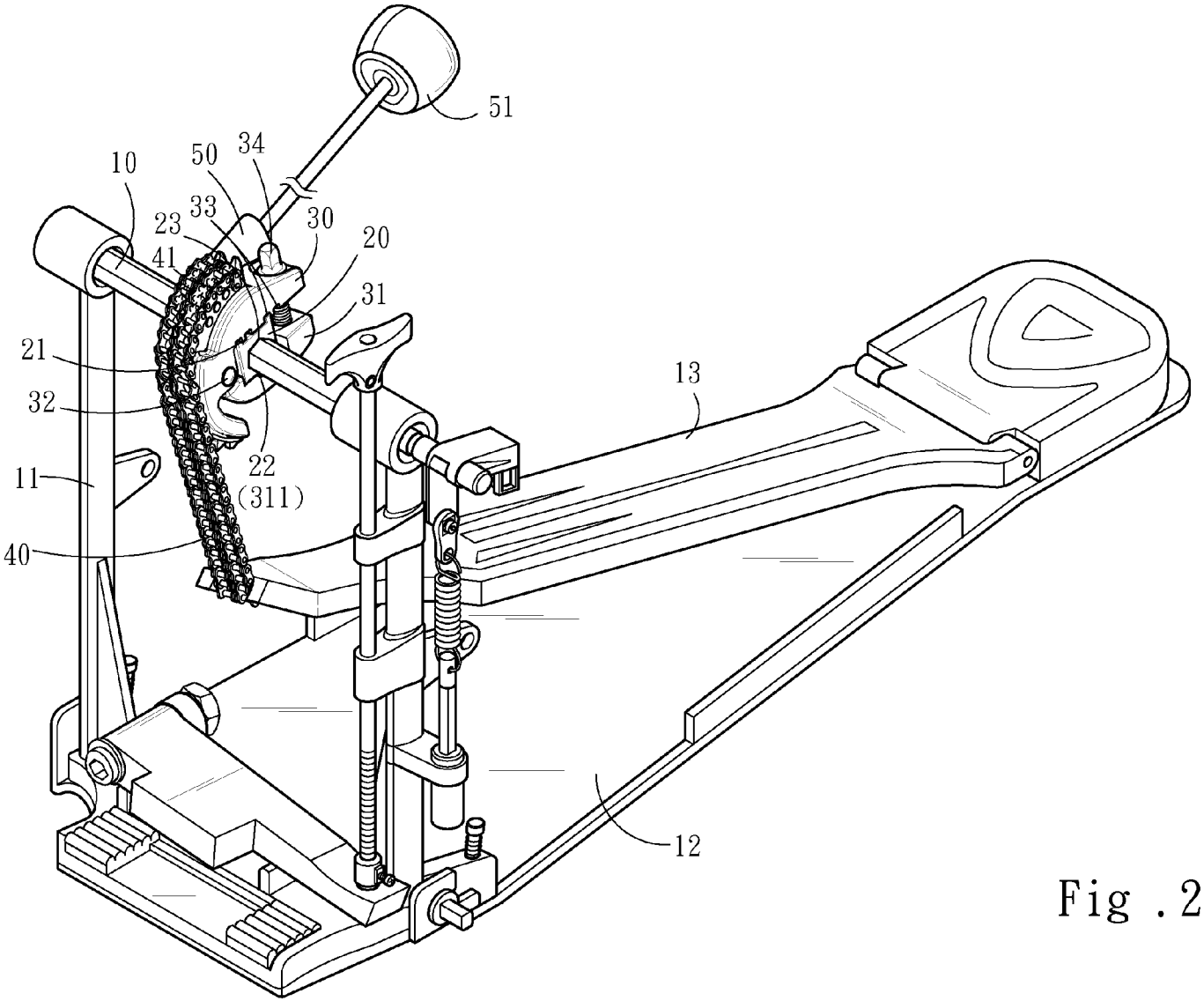
FIG. 2 is a perspective view of an embodiment of the present invention installed on a foot pedal percussion instrument.
Figure 3:
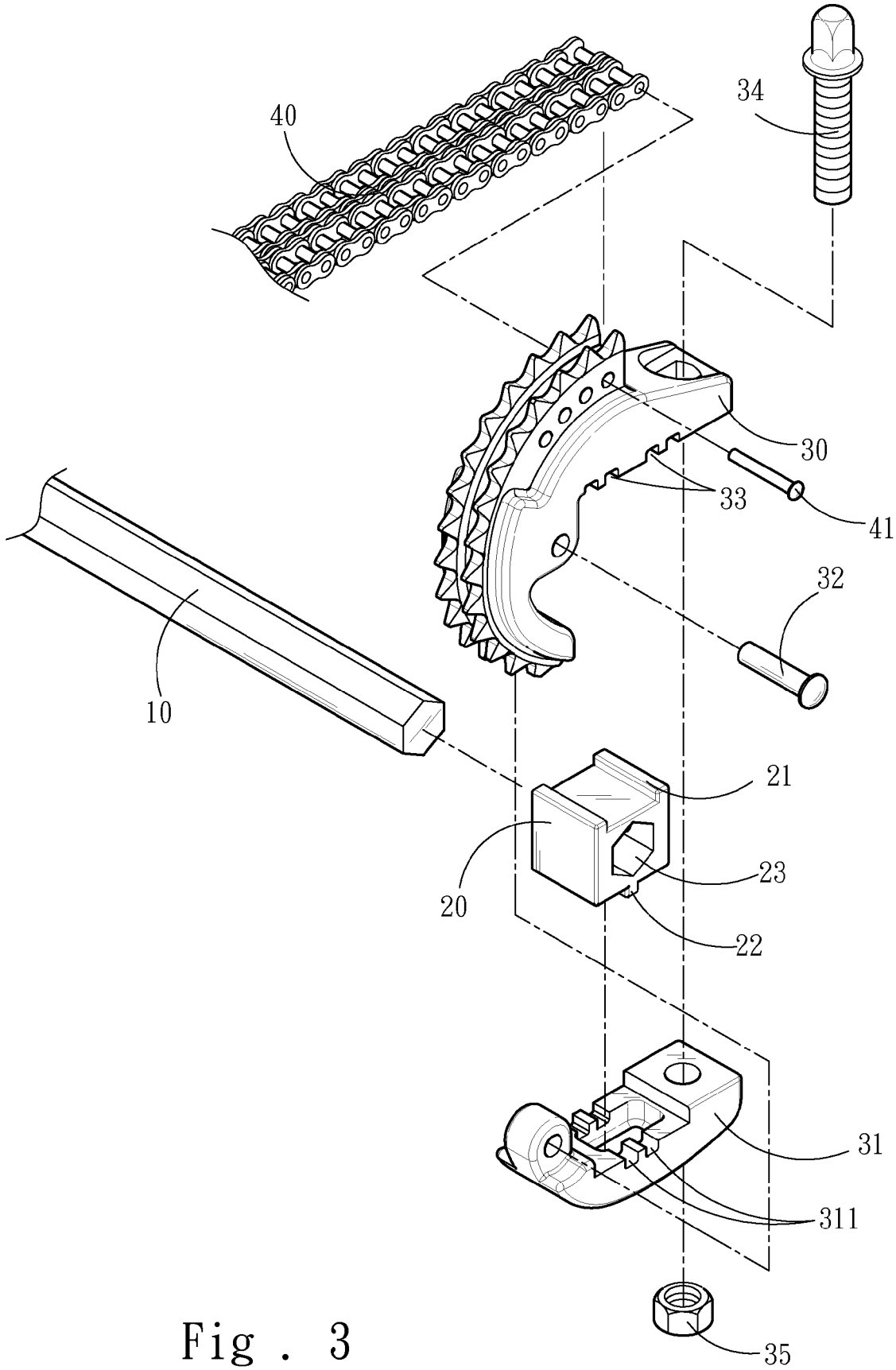
FIG. 3 is an exploded view of an embodiment of the present invention.
Figure 4:
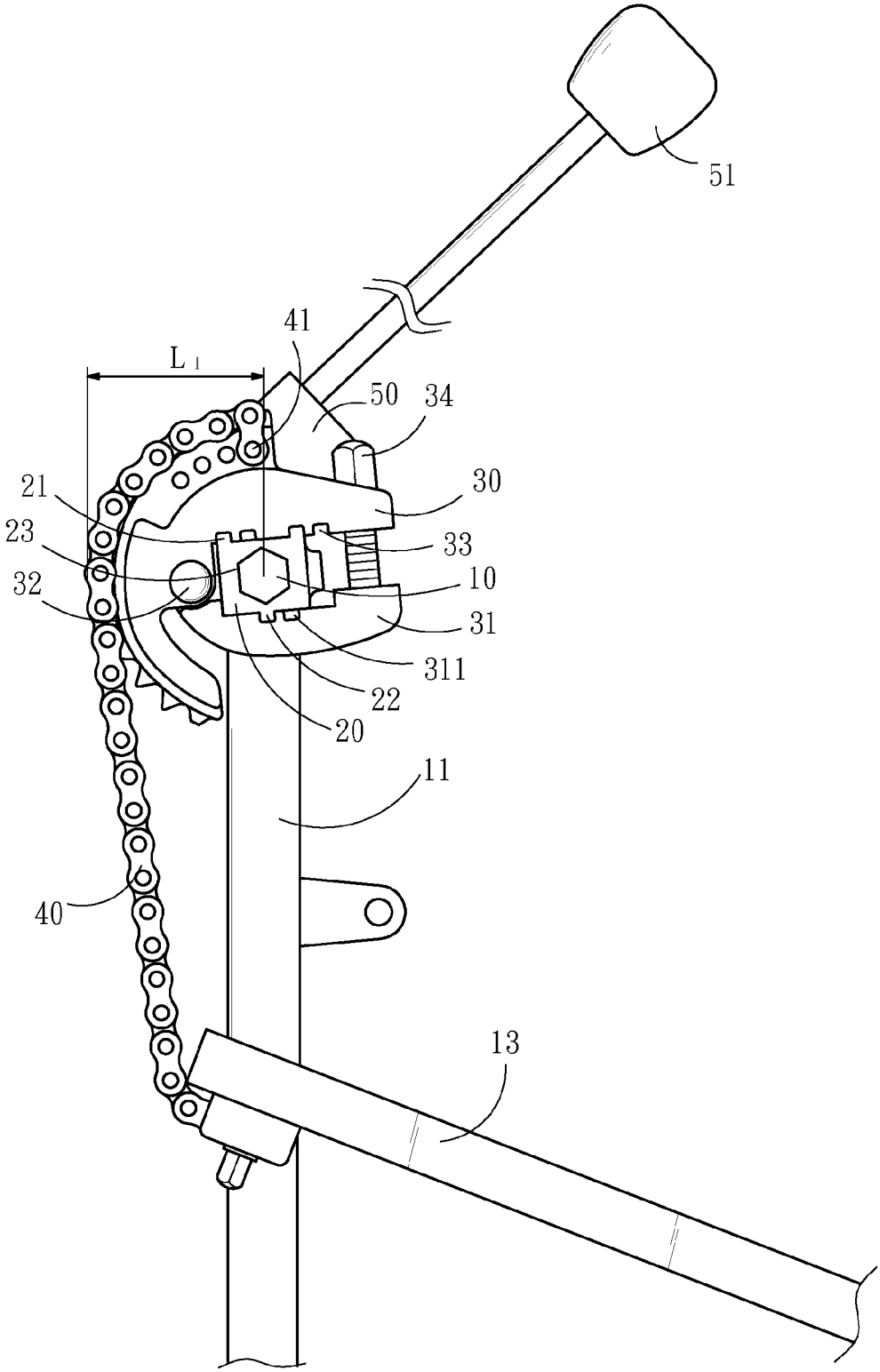
FIG. 4 is a plane view of an embodiment of the present invention.

Please refer to FIGS. 2 through 4, the present invention provides a foot pedal striking adjustment apparatus installed on an axle 10 of a foot pedal percussion instrument. The axle 10 is formed with a polygonal cross section and has two ends hinged on an upper side of a pair of bracing posts 11. The bracing posts 11 have a lower side fastened to a foot pedal holder 12. The foot pedal holder 12 has a rear side hinged on a pedal 13. The foot pedal striking adjustment apparatus comprises a flywheel holder 20, a flywheel 30 and a drawing element 40.

The flywheel holder 20 is cubical and has at least one first protruding tooth 21 on an upper side (in this embodiment two sets of the first protruding tooth 21 are provided) and at least one second protruding tooth 22 at a lower side, and a polygonal hole 23 in the center is run through by the axle 10 transversely so that the flywheel holder 20 and the axle 10 are turnable concurrently.

The flywheel 30 in this embodiment is a chain wheel with a plurality of pin holes formed on the periphery. The flywheel 30 has a lower front side hinged on a clamping element 31 through an axle pin 32 such that the rear side of the clamping element 31 is open and movable. The clamping element 31 and the flywheel 30 form an elongate clamping space between them. The flywheel holder 20 is held in the clamping space. The flywheel 30 and the clamping element 31 can be moved forwards and rearwards to clamp the flywheel holder 20. The flywheel 30 has at least two first notches 33 at a lower side (in this embodiment four first notches 33 are provided) that are engageable with the first protruding teeth 21 to form a first interlock portion. The clamping element 31 also has at least two second notches 311 on an upper side engageable with the second protruding tooth 22 to form a second interlock portion. The clamping element 31 has a rear side fastened by a fastening element 34, such as a bolt, which runs through the flywheel 30 to engage with a nut 35 to incorporate with the flywheel 30 to clamp the flywheel holder 20.

The drawing element 40 may be a chain with an upper end engaged with a plurality of chain teeth formed on the circumference of the chain wheel. The last chain link at the upper end of the chain is fastened to a pin hole of the chain wheel by inserting a pin 41. The chain has a lower end connected to the front end of the pedal 13 such that the pedal 13 is formed in an inclined manner with the front end at a higher elevation.

The present invention also includes a drumstick holder 50 coupled on the axle 10 to turn concurrently. The drumstick holder 50 holds a drumstick 51 which can be turned with the drumstick holder 50 to strike a head of a drum (not shown in the drawings).

Figure 5:
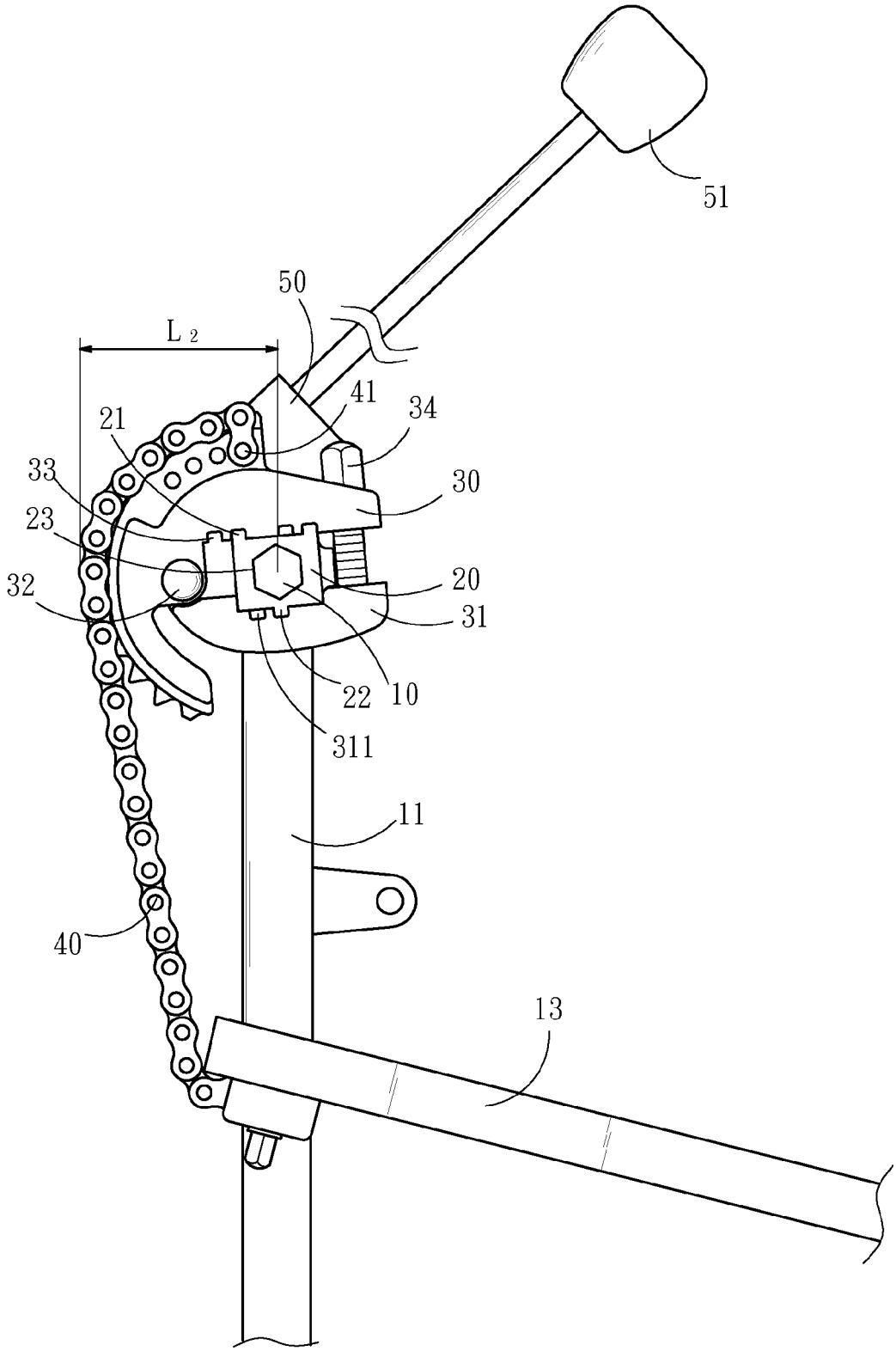
FIG. 5 is another plane view of an embodiment of the present invention.

Referring to FIGS. 4 and 5, as the flywheel holder 20 is coupled on the axle 10 and turned synchronously therewith, the flywheel 30 and the clamping element 31 clamp the flywheel holder 20 in an up and down manner so that the flywheel 30 is driven by the flywheel holder 20 to turn, and the drawing element 40 has the upper end fastened to the flywheel 30 and lower end fastened to the pedal 13, a performer can step the pedal 13 to draw the drawing element 40 downwards to drive the flywheel 30 to turn such that the drumstick 51 can strike the head of the drum.

When the gradient of the pedal 13 is changed, the stepping force of the foot on the pedal 13 can also be adjusted. Since the front end of the pedal 13 is hoisted by the drawing element 40 in an inclined manner, by adjusting the pendent range of the drawing element 40, the gradient of the pedal 13 can be changed. This can be accomplished by unfastening the fastening element 34 to change the engaged positions of the first notches 33 of the flywheel 30 and second notches 311 of the clamping element 31 against the first and second protruding teeth 21 and 22 of the flywheel holder 20, thereby the radii L1 and L2 between the center of the axle 10 and the flywheel 30 are different. Then the pendent range of the drawing element 40 also be changed and the gradient of the pedal 13 can be altered to further adjust the striking force on the drum according to different musical composition. Operation is simpler and can be accomplished rapidly.

What is claimed is:

1. A foot pedal striking adjustment apparatus installed on an axle of a foot pedal percussion instrument, the axle being hinged on an upper side of a pair of bracing posts that include a lower side fastened to a foot pedal holder which includes a rear side hinged on a pedal, the foot pedal striking adjustment apparatus comprising:

a flywheel holder which includes a center run through transversely by the axle;

a flywheel including a lower front side hinged by a clamping element to form a clamping space therebetween to hold the flywheel holder; the flywheel and the clamping element being movable forwards and rearwards, the clamping element including a rear side opened which is fastened to the flywheel by a fastening element to clamp the flywheel holder; and a drawing element which includes an upper end connected to the flywheel on the circumference and a lower end connected to a front end of the pedal such that the pedal is formed in an inclined manner with a front end at a higher elevation.

2. The foot pedal striking adjustment apparatus of claim 1, wherein the flywheel is a chain wheel, the drawing element being a chain which includes a plurality of chain links at an upper end engaged with a plurality of chain teeth formed on the circumference of the chain wheel, the chain wheel further including a plurality of pin holes on the periphery, the last chain link at the upper end of the chain being run through by a pin and fastened to one of the pin holes, the chain including a lower end connected to the front end of the pedal.

3. The foot pedal striking adjustment apparatus of claim 1, wherein the flywheel holder is cubical, the flywheel and the flywheel holder being positioned through a first interlock portion, the clamping element and the flywheel holder being positioned through a second interlock portion.

4. The foot pedal striking adjustment apparatus of claim 3, wherein the flywheel includes at least two first notches on a lower side, the flywheel holder including at least one first protruding tooth on an upper side engageable with the first notches to form the first interlock portion.

5. The foot pedal striking adjustment apparatus of claim 3, wherein the clamping element includes at least two second notches on a upper side, the flywheel holder including at least one second protruding tooth on a lower side engageable with the second notches to form the second interlock portion.

6. The foot pedal striking adjustment apparatus of claim 1, wherein the fastening element is a bolt running through a rear end of the flywheel and the clamping element to engage with a nut.

7. The foot pedal striking adjustment apparatus of claim 1, wherein the axle is formed with a polygonal cross section, the flywheel holder including a polygonal hole in the center.

8. The foot pedal striking adjustment apparatus of claim 1, wherein the axle is coupled with a drumstick holder which is turnable synchronously with the axle and fastened to a drumstick.

9. The foot pedal striking adjustment apparatus of claim 1, wherein the flywheel and the clamping element are hinged together by inserting an axle pin.

* * * * *